US007473444B2

(12) United States Patent
Seko et al.

(10) Patent No.: US 7,473,444 B2
(45) Date of Patent: Jan. 6, 2009

(54) METHOD OF FORMING COATING FILM

(75) Inventors: Kenji Seko, Yokosuka (JP); Kazuhiro Masuda, Hiratsuka (JP); Yoshizumi Matsuno, Hadano (JP)

(73) Assignee: Kansai Paint Co., Ltd., Amagasaki-Shi (JP)

( * ) Notice: Subject to any disclaimer, the term of this patent is extended or adjusted under 35 U.S.C. 154(b) by 898 days.

(21) Appl. No.: 10/500,140

(22) PCT Filed: Jan. 20, 2003

(86) PCT No.: PCT/JP03/00399

§ 371 (c)(1),
(2), (4) Date: Jul. 8, 2004

(87) PCT Pub. No.: WO03/061850

PCT Pub. Date: Jul. 31, 2003

(65) Prior Publication Data

US 2005/0079366 A1 Apr. 14, 2005

(30) Foreign Application Priority Data

Jan. 21, 2002 (JP) ..... 2002-012103

(51) Int. Cl.
*B05D 3/02* (2006.01)
*B05D 3/06* (2006.01)

(52) U.S. Cl. ..... 427/493; 427/355; 427/356; 427/358; 427/368

(58) Field of Classification Search ..... 427/493, 427/355, 356, 358, 368
See application file for complete search history.

(56) References Cited

U.S. PATENT DOCUMENTS

| | | | | |
|---|---|---|---|---|
| 5,093,223 | A | 3/1992 | Iwasawa et al. | 430/280 |
| 5,106,651 | A | 4/1992 | Tyger et al. | |
| 6,332,291 | B1 | 12/2001 | Flosbach et al. | |
| 6,506,458 | B1 | 1/2003 | Blatter et al. | |
| 6,605,669 | B2 * | 8/2003 | Awokola et al. | 525/123 |

FOREIGN PATENT DOCUMENTS

| | | | |
|---|---|---|---|
| DE | 3814422 | | 6/1989 |
| DE | 198 18 735 | A1 | 10/1999 |
| DE | 199 13 442 | A1 | 9/2000 |
| DE | 101 27 962 | A1 | 12/2002 |
| EP | 0 247 563 | B1 | 8/1995 |
| JP | 64-11169 | | 1/1989 |
| JP | 64-011169 | | 1/1989 |
| JP | 2-99171 | | 4/1990 |
| JP | 5-123643 | | 5/1993 |
| JP | 11-61033 | | 3/1999 |
| JP | 11-300272 | | 11/1999 |
| JP | 2001-040247 | | 2/2001 |
| WO | WO 00/58027 | * | 10/2000 |

OTHER PUBLICATIONS

German Office Action dated Oct. 29, 2007.
German Patent Office Action for corresponding German patent application No. 103 92 212.1-45, dated Dec. 5, 2005.
Japanese Patent Office Notification for corresponding Japanese patent application No. 2003-561782, dated Mar. 28, 2006. (Citing References AA, AF-AH.).
International Search Report dated May 6, 2003.

* cited by examiner

*Primary Examiner*—Erma Cameron
(74) *Attorney, Agent, or Firm*—Kratz, Quintos & Hanson, LLP

(57) ABSTRACT

The present invention provides a method of forming a coating film on a substrate comprising the steps of:

(i) coating the substrate with a thermosetting and photocurable coating composition to form a wet coating film,
(ii) heating the wet coating film to semicure the coating film, and
(iii) irradiating the semicured coating film with light to cure the coating film.

6 Claims, No Drawings

METHOD OF FORMING COATING FILM

TECHNICAL FIELD

The present invention relates to a method of forming a coating film.

BACKGROUND ART

For the formation of a coating film on the bodies of vehicles such as automobiles, motorcycles, container vehicles and the like, a method is widely used which comprises applying a thermosetting coating composition to the vehicle body to be coated, and thereafter curing the applied coating composition by heating. This method can form a coating film having excellent properties in terms of adhesion, finish quality, weatherability, etc.

The above-mentioned coating film formation method is now required to reduce energy consumption and increase productivity. For example, the heat-curing step on an automobile body coating line is usually conducted at about 140° C. for about 40 minutes; when the conveyor runs at a speed of 3 m/min, the step requires a space for the drying furnace line about 120 m in length. Therefore, in order to save space and energy, shortening of the heating time is demanded in the heat-curing step.

To shorten the heating time in the formation of a coating film, Japanese Unexamined Patent Publication No. 1989-11169 discloses a method of coating a substrate with an ultraviolet-curable and thermosetting coating composition, and then carrying out ultraviolet irradiation followed by heating at about 90° C. to about 160° C. for about 5 to about 20 minutes to form a cured coating film. However, this coating film formation method is disadvantageous in that ultraviolet irradiation promotes the curing of a coating film surface alone, thus preventing sufficient thermal flow of the film at the time of heating, resulting in uneven curing of the film and impaired smoothness of the film surface. The obtained cured coating film, therefore, tends to be reduced in terms of adhesion, finish quality, weatherability and other film properties. Moreover, because dust or other foreign matter adhering to a wet coating film surface before curing is firmly fixed by the curing of the film surface by ultraviolet irradiation, its removal at the time of repair is difficult.

DISCLOSURE OF THE INVENTION

An object of the present invention is to provide a novel method of forming a coating film such that a cured coating film can be formed that has excellent adhesion, finish quality, weatherability, etc., as in the above-mentioned conventional coating film formation method; dust or other foreign matter adhering to the coating film surface can be easily removed at the time of repair; and the method contributes to saving energy and increasing productivity.

Other objects and features of the invention will be apparent from the following description.

In order to achieve the above objects, the present inventors conducted extensive research. As a result, the inventors found that a cured coating film having excellent adhesion, finish quality, weatherability, etc. can be formed by coating a substrate with a thermosetting and photocurable coating composition, then heating the resulting coating film to semicure it, followed by irradiating the semicured coating film with light to cure it; that dust and the like adhering to the coating film surface can be easily removed by carrying out repair between heating and irradiating with light; and that the method contributes to saving energy and increasing productivity. Based on these novel findings, the present inventors carried out further research and accomplished the present invention.

The present invention provides a method of forming a coating film as follows.

Item 1: A method of forming a coating film on a substrate comprising the steps of:

(i) coating the substrate with a thermosetting and photocurable coating composition to form a wet coating film, (ii) heating the wet coating film to semicure the coating film, and (iii) irradiating the semicured coating film with light to cure the coating film.

Item 2: A method of forming a coating film according to item 1, wherein the coating composition comprises a thermosetting and photocurable resin component (A), a crosslinking agent (B), a photopplymerization initiator (C), and an organic solvent (D).

Item 3: A method of forming a coating film according to item 2, wherein the resin component (A) is at least one compound selected from the group consisting of radical-polymerizable unsaturated monomers, resins containing radical-polymerizable unsaturated groups, resins containing radical-polymerizable unsaturated groups and thermosetting functional groups, and resins containing thermosetting functional groups.

Item 4: A method of forming a coating film according to item 2, wherein the coating composition comprises, per 100 parts by weight of the thermosetting and photocurable resin component (A), about 10 to about 60 parts by weight of the crosslinking agent (B) and about 0.1 to about 10 parts by weight of the photopolymerization initiator (C).

Item 5: A method of forming a coating film according to item 2, wherein the coating composition comprises the organic solvent (D) in such an amount that the coating composition has a solids content of about 20% to about 90% by weight.

Item 6: A method of forming a coating film according to item 1, wherein the wet coating film is heated at about 50° C. to about 200° C. for about 5 to about 30 minutes.

Item 7: A method of forming a coating film according to item 1, wherein the semicured coating film is irradiated with ultraviolet light having a wavelength of about 200 to about 450 nm at a dosage of about 100 to about 2,000 mJ/cm$^2$.

Item 8: A method of forming a coating film according to item 1, further comprising after step (ii), a step of repairing the coating film.

Item 9: A method of forming a coating film according to item 1, wherein the substrate to be coated is a vehicle body.

Item 10: A method of forming a coating film according to item 9, wherein the substrate to be coated is an automobile body.

Item 11: A vehicle body on which a coating film is formed by the method of forming a coating film according to item 1.

Item 12: An automobile body on which a coating film is formed by the method of forming a coating film according to item 1.

The method of forming a coating film according to the present invention is described below in detail.

Substrate to be Coated

Although the substrate to be coated according to the method of the present invention is not limited, the bodies of vehicles such as automobiles, motorcycles, container vehicles and the like are preferable. Other examples of substrates to be coated are materials for vehicle body components, including metal substrates such as aluminum sheets and plates, aluminum alloy sheets and plates, steel sheets and plates such as cold-rolled steel sheets and plates, galvanized steel sheets and plates, zinc alloy-plated steel sheets and plates, stainless steel sheets and plates, tin-plated steel sheets and plates, etc.; various plastic substrates; and so on.

The metal surface of a vehicle body or metal substrate to be coated may be treated by phosphating, chromating, mixed oxide treatment, etc. Further, the vehicle body, metal substrate, etc. to be coated may have an undercoating film and/or an intermediate coating film and/or top coating film, which are formed from various electrodeposition coating compositions, etc.

Thermosetting and Photocurable Coating Composition

The coating composition of the invention preferably comprises a thermosetting and photocurable resin component (A), a crosslinking agent (B), a photopolymerization initiator (C), and an organic solvent (D).

The thermosetting and photocurable resin component (A) is preferably at least one compound selected from the group consisting of radical-polymerizable unsaturated monomers, resins containing radical-polymerizable unsaturated groups, resins containing radical-polymerizable unsaturated groups and thermosetting functional groups, and resins containing thermosetting functional groups. In order to impart thermosetting and photocurable properties to the resin component (A), it is preferable to select a resin containing radical-polymerizable unsaturated groups and thermosetting functional groups or to combine two or more compounds suitably selected from the above group so that the resin component (A) has both radical-polymerizable unsaturated groups and thermosetting functional groups.

A radical-polymerizable unsaturated monomer is a monomer that has one or more radical-polymerizable unsaturated groups per molecule. Such monomers are selected from the group consisting of monofunctional polymerizable monomers having one radical-polymerizable unsaturated group per molecule, bifunctional polymerizable monomers having two radical-polymerizable unsaturated groups per molecule, and polyfunctional polymerizable monomers having three or more radical-polymerizable unsaturated groups per molecule. These monomers may be used singly or in combination of two or more. Examples thereof are given below.

Examples of monofunctional polymerizable monomers include styrene, methyl (meth)acrylate, ethyl (meth)acrylate, butyl (meth)acrylate, 2-ethylhexyl (meth)acrylate, lauryl (meth)acrylate, cyclohexyl (meth)acrylate, cyclohexenyl (meth)acrylate, 2-hydroxyl (meth)acrylate, hydroxypropyl (meth)acrylate, tetrahydrofurfuryl (meth)acrylate, ϵ-caprolactone-modified tetrahydrofurfuryl (meth)acrylate, phenoxyethyl (meth)acrylate, phenoxy polyethylene glycol (meth)acrylate, dicyclopentenyl (meth)acrylate, dicyclopentenyloxyethyl (meth)acrylate, isobornyl (meth)acrylate, benzyl (meth)acrylate, ϵ-caprolactone-modified hydroxyethyl (meth)acrylate, polyethylene glycol mono(meth)acrylate, polypropylene glycol mono(meth)acrylate, 2-hydroxy-3-phenoxypropyl (meth)acrylate, 2-hydroxy-3-butoxypropyl (meth)acrylate, phthalic acid monohydroxyethyl (meth)acrylate, para-cumylphenol ethylene oxide-modified (meth)acrylate, N-methylol (meth)acrylamide, N-methylol (meth)acrylamide butyl ether, acryloyl morpholine, dimethylaminoethyl (meth)acrylate, N-vinyl-2-pyrrolidone, etc.

Examples of bifunctional polymerizable monomers include ethylene glycol di(meth)acrylate, diethylene glycol di(meth)acrylate, polyethylene glycol di(meth)acrylate, propylene glycol di(meth)acrylate, dipropylene glycol di(meth)acrylate, polypropylene glycol di(meth)acrylate, neopentyl glycol di(meth)acrylate, 1,4-butanediol di(meth)acrylate, 1,6-hexanediol di(meth)acrylate, bisphenol-A ethylene oxide-modified di(meth)acrylate, bisphenol-A propylene oxide-modified di(meth)acrylate, 2-hydroxy-1-acryloxy-3-methacryloxypropane, tricyclodecane dimethanol di(meth)acrylate, di(meth)acryloyloxyethyl acid phosphate, etc. Usable bifunctional monomers include those monomers that are commercially available under the trade names of "KAYARAD HX-220," "KAYARAD HX-620," "KAYARAD R-604," "MANDA," and so on (products of Nippon Kayaku Co., Ltd.).

Examples of polyfunctional polymerizable monomers having three or more radical-polymerizable unsaturated groups per molecule include trimethylolpropane tri(meth)acrylate, trimethylolpropane ethylene oxide-modified tri(meth)acrylate, trimethylolpropane propylene oxide-modified tri(meth)acrylate, glycerin tri(meth)acrylate, glycerin ethylene oxide-modified tri(meth)acrylate, glycerin propylene oxide-modified tri(meth)acrylate, pentaerythritol tri(meth)acrylate, pentaerythritol tetra(meth)acrylate, isocyanuric acid ethylene oxide-modified triacrylate, dipentaerythritol hexa(meth)acrylate, etc.

In view of the photocurability of the coating composition, mar resistance of the cured coating film, etc., preferable radical-polymerizable unsaturated monomers are those polymerizable monomers that have two or more radical-polymerizable unsaturated groups per molecule.

Examples of resins containing radical-polymerizable unsaturated groups include unsaturated acrylic resins, unsaturated urethane resins, unsaturated epoxy resins, polyester (meth)acrylates, unsaturated silicone resins, etc. These resins may be used singly or in combination of two or more.

A resin containing radical-polymerizable unsaturated groups and thermosetting functional groups is a resin that has one or more radical-polymerizable unsaturated groups and one or more thermosetting functional groups per molecule. From the viewpoint of the curability of the coating composition, it is preferable that the resin contain two or more radical-polymerizable unsaturated groups and two or more thermosetting functional groups per molecule. Examples of thermosetting functional groups are hydroxyl group, acid groups, epoxy group, isocyanate group, and like functional groups. Examples of the acid groups include carboxyl group, phosphate group, etc.

Examples of resins containing radical-polymerizable unsaturated groups and thermosetting functional groups include acrylic resins containing radical-polymerizable unsaturated groups and hydroxyl groups, acrylic resins containing radical-polymerizable unsaturated groups and carboxyl groups, acrylic resins containing radical-polymerizable unsaturated groups and epoxy groups, acrylic resins containing radical-polymerizable unsaturated groups and isocyanate groups, polyester resins containing radical-polymerizable unsaturated groups and hydroxyl groups, polyester resins containing radical-polymerizable unsaturated groups and carboxyl groups, cresol novolac epoxy resins containing radical-polymerizable unsaturated groups and epoxy groups, etc. These resins may be used singly or in combination of two or more.

A resin containing thermosetting functional groups is a resin that has one or more thermosetting functional groups per molecule. In view of the thermosetting properties of the coating composition, it is preferable that the resin contain two or more thermosetting functional groups per molecule. Examples of thermosetting functional groups are hydroxyl group, acid groups, epoxy group, isocyanate group, and the like. Examples of the acid groups include carboxyl group, phosphate group, etc.

Examples of resins containing thermosetting functional groups include hydroxyl-containing acrylic resins, hydroxyl-containing polyester resins, carboxyl-containing acrylic resins, carboxyl-containing polyester resins, epoxy-containing acrylic resins, epoxy-containing polyester resins, etc. These resins may be used singly or in combination of two or more.

The crosslinking agent (B) is a compound that undergoes a crosslinking reaction with the thermosetting functional groups of the resin component (A). When the thermosetting functional group is hydroxyl group, for example, amino resins, polyisocyanate compounds, etc. can be used as the crosslinking agent (B). When the thermosetting functional group is carboxyl group, for example, epoxy-containing compounds, etc. can be used as the crosslinking agent (B).

Examples of the above amino resins include melamine resins, guanamine resins, urea resins, etc. To improve the weatherability, etc. of the coating film, melamine resins are especially preferable. These amino resins may be used in combination with a curing catalyst.

Examples of the above polyisocyanate compounds are organic diisocyanates, including aliphatic diisocyanates such as hexamethylene diisocyanate, trimethyl hexamethylene diisocyanate, and the like; alicyclic diisocyanates such as hydrogenated xylylene diisocyanate, isophorone diisocyanate, and the like; aromatic diisocyanates such as tolylene diisocyanate, 4,4'-diphenylmethane diisocyanate, and the like; adducts of these organic diisocyanates with polyhydric alcohols, low-molecular-weight polyester resins, water, or the like; isocyanurate-modified organic diisocyanates such as isocyanurate-modified hexamethylene diisocyanate, isocyanurate-modified isophorone diisocyanate, and the like; cyclic polymers of organic diisocyanates; biurets of organic diisocyanates; etc. These polyisocyanate compounds may be blocked with a blocking agent. When using a blocked polyisocyanate compound, it is preferable to use the compound in combination with a catalyst for the dissociation of a blocking agent.

Compounds that contain an average of two or more epoxy groups per molecule can be used as the above epoxy-containing compounds without restriction. Acrylic resins obtained by copolymerizing epoxy-containing unsaturated monomers and other unsaturated monomers are especially preferable in view of the weatherability, etc. of the coating film.

Crosslinking agents (B) may be used singly or in combination of two or more. In order to improve the thermosetting properties of the coating composition, the amount of crosslinking agent (B) is preferably within the range of about 10 to about 60 parts by weight, and more preferably within the range of about 20 to about 50 parts by weight, per 100 parts by weight of thermosetting and photocurable resin component (A).

The photopolymerization initiator (C) is a compound that triggers the radical polymerization of the radical-polymerizable unsaturated groups contained in the resin component (A) to cure the coating composition.

Examples of the photopolymerization initiator (C) include benzoin, benzoin methyl ether, benzoin ethyl ether, benzoin isobutyl ether, diethoxyacetophenone, 2-hydroxy-2-methyl-1-phenylpropane-1-one, benzyl dimethyl ketal, 1-hydroxycyclohexyl-phenylketone, 2-methyl-2-morpholino(4-thiomethylphenyl)propane-1-one, 2-benzyl-2-dimethylamino-1-(4-morpholinophenyl)-butanone, 2,4,6-trimethylbenzoylphenylphosphine oxide, 2,4,6-trimethylbenzoylphenylethoxyphosphine oxide, benzophenone, methyl o-benzoylbenzoate, hydroxybenzophenone, 2-isopropylthioxanthone, 2,4-dimethylthioxanthone, 2,4-diethylthioxanthone, 2,4-dichlorothioxanthone, 2,4,6-tris(trichloromethyl)-s-triazine, 2-methyl-4,6-bis(trichloro)-s-triazine, 2-(4-methoxyphenyl)-4,6-bis(trichloromethyl)-s-triazine, etc.

Photopolymerization initiators (C) may be used singly or in combination of two or more. To obtain better photocuring properties of the coating composition, the amount of photopolymerization initiator (C) is preferably within the range of about 0.1 to about 10 parts by weight, and more preferably within the range of about 0.2 to about 5 parts by weight, per 100 parts by weight of thermosetting and photocurable resin component (A).

The photopolymerization initiator (C) may be used in combination with a photosensitizer to accelerate the photopolymerization reaction by the photopolymerization initiator.

Examples of usable photosensitizers include tertiary amine compounds such as triethylamine, triethanolamine, methyldiethanolamine, methyl 4-dimethylaminobenzoate, ethyl 4-dimethylaminobenzoate, isoamyl 4-dimethylaminobenzoate, (2-dimethylamino)ethyl benzoate, 4,4'-diethylaminobenzophenone, etc.; alkylphosphine compounds such as triphenylphosphine, etc.; thioether compounds such as β-thiodiglycol, etc.; and so on.

Photosensitizers may be used singly or in combination of two or more. The amount of photosensitizer to be used is preferably within the range of about 0.1 to about 5 parts by weight, per 100 parts by weight of thermosetting and photocurable resin component (A).

The thermosetting and photocurable coating composition used in the present invention preferably contains an organic solvent (D) to improve finish quality and workability.

An inert organic solvent, which scarcely reacts with the thermosetting and photocurable resin component (A), can be used without restriction as the organic solvent (D). Examples of organic solvents include aromatic solvents such as toluene, xylene, etc.; ester solvents such as ethyl acetate, propyl acetate, butyl acetate, methoxybutyl acetate, amyl acetate, methyl cellosolve acetate, cellosolve acetate, diethylene glycol monomethyl ether acetate, carbitol acetate, etc.; ether solvents such as dioxane, ethylene glycol diethyl ether, ethylene glycol dibutyl ether, etc.; ketone solvents such as acetone, methyl ethyl ketone, methyl isobutyl ketone, etc.; and so on.

Organic solvents (D) may be used singly or in combination of two or more. To enhance the finish quality of the coating composition, the coating composition preferably contains organic solvent (D) in such an amount that the coating composition has a solids content of about 20% to about 90% by weight. More preferably, the coating composition contains organic solvent (D) in such an amount that the coating composition has a solids content of about 30% to about 70% by weight.

The coating composition used in the present invention may be a clear coating composition or may be a colored coating composition containing a coloring pigment and/or an effect pigment. The coating composition may optionally contain other pigments such as extender pigments and the like.

Examples of coloring pigments include inorganic pigments such as titanium dioxide, iron oxides, etc.; organic pigments such as phthalocyanine blue, quinacridone red, perylene red, phthalocyanine green, etc.; and so on. Examples of effect pigments include aluminum flakes, mica flakes, etc. Extender pigments are, for example, barium sulfate, calcium carbonate, talc, clay, etc.

If necessary, the coating composition used in the present invention may further contain known additives such as ultraviolet absorbers, light stabilizers, surface modifiers, anti-sagging agents, anti-settling agents, plasticizers, etc.

Steps in the Method of Forming a Coating Film

The method of forming a coating film of the present invention comprises the steps of:

(i) coating a substrate with a thermosetting and photocurable coating composition to form a wet coating film, (ii) heating the wet coating film to semicure the coating film, and (iii) irradiating the semicured coating film with light to cure the coating film.

Step (i), which is a coating step, can be accomplished by coating a substrate with a thermosetting and photocurable coating composition by a known coating method. A wet coating film can be formed by methods such as spray coating, electrostatic coating, curtain coating, etc. After coating, the coating film may be optionally left to stand for setting. To enhance workability, spray coating is preferable. The coating composition is usually applied to a coating film thickness of about 10 to about 70 μm (as cured).

In addition, when carrying out spray coating, it is preferable to use an organic solvent to adjust the viscosity of the coating composition to a viscosity range suitable for the coating method, which is usually a viscosity range of about 15 to about 40 seconds at 20° C. (viscometer: Ford cup No. 4).

Step (ii) is carried out by heating the wet coating film obtained in step (i) to semicure the coating film. This heating step can be accomplished by known heating means. Examples thereof include drying furnaces such as air-heating furnaces, electric furnaces, infrared induction heating furnaces, etc.

In the above heat-curing step, the wet coating film is preferably heated at about 50° C. to about 200° C. for about 5 to about 30 minutes. Heating under such conditions allows the thermosetting component of the wet coating films to cure, resulting in a semicured coating film. A "semicured coating film" herein means a coating film that has cured to a hardness between about 2B to about H on the pencil hardness scale. The wet coating film is more preferably heated at about 70° C. to about 160° C. for about 10 to about 20 minutes.

Under the above heating conditions in the heat-curing step on an automobile body coating line, a coating film can be semicured by, for example, heating at about 140° C. for about 20 minutes. When the conveyor speed is 3 m/min, the step requires a space for a drying furnace line with a length of about 60 m, which is about half the length usually required. Space and energy thus can be saved.

It is preferable to perform after the above heat-curing step (ii), a step of repairing the coating film to improve its surface quality. In the repairing step, dust or other foreign matter adhering to the wet coating film surface before heating is removed by grinding the heated semicured coating film. Subsequently, the coating film is polished with a polishing agent to erase traces left by grinding. Since the coating film is semicured, dust and the like adhering to the coating film surface can be easily removed in this repair step, and subsequent polishing of the coating film becomes easy.

Step (iii) is conducted by irradiating with light the semicured coating film obtained in step (ii) to substantially fully cure the coating film.

The preferable irradiating light is usually ultraviolet light having a wavelength of about 200 to about 450 nm. A light source can be suitably selected to provide wavelengths to which a selected photopolymerization initiator is highly sensitive. Examples of sources of the above-mentioned ultraviolet light include high pressure mercury lamps, ultrahigh pressure mercury lamps, xenon lamps, carbon arc lamps, metal halide lamps, sunlight, etc. The coating film is irradiated with ultraviolet light at an intensity of preferably about 100 to about 2,000 mJ/cm$^2$, and more preferably about 500 to about 1,500 mJ/cm$^2$. The irradiation time is usually about 3 to about 60 seconds. The coating film can be substantially fully cured in this photocuring step.

BEST MODE FOR CARRYING OUT THE INVENTION

The present invention is described below in more detail with reference to Production Examples, Examples and Comparative Examples. However, the present invention is not limited by these examples. In these examples, parts and percentages are expressed on a weight basis unless otherwise indicated.

PRODUCTION EXAMPLE 1

Production of Resin Containing Radical-Polymerizable Unsaturated Groups

Eight hundred and eighty-eight parts of isophorone diisocyanate, 464 parts of 2-hydroxyethyl acrylate and 0.7 parts of hydroquinone monomethyl ether were placed into a reaction vessel equipped with a thermometer, a thermostat, a stirrer, a reflux condenser and an air blower. While blowing air into the reaction vessel, the mixture was heated to 80° C. and maintained at the same temperature for 5 hours. After confirming substantially all the 2-hydroxyethyl acrylate had reacted, an adduct of isophorone diisocyanate and 2-hydroxyethyl acrylate was obtained. Subsequently, 136 parts of pentaerythritol, 372 parts of butyl acetate and 0.2 parts of dibutyltin dilaurate were added to the adduct, and the mixture was further maintained at 80° C. After confirming substantially all the isophorone diisocyanate had reacted, the mixture was cooled, giving a solution of resin (resin No. 1) containing radical-polymerizable unsaturated groups with a resin solids content of 80%. The resin had a number average molecular weight of about 1,500 and about four radical-polymerizable unsaturated groups per molecule.

PRODUCTION EXAMPLE 2

Production of Resin Containing Radical-Polymerizable Unsaturated Groups and Hydroxyl Groups Four hundred and eighty parts of butyl acetate was placed into a reaction vessel equipped with a thermometer, a thermostat, a stirrer, a reflux condenser and a dropping funnel, and was heated to 130° C. while feeding nitrogen gas into the reaction vessel. While maintaining the same temperature, a mixed solution of the following monomers and polymerization initiator was added dropwise over 3 hours via the dropping funnel.

| | |
|---|---|
| styrene | 200 parts |
| methyl methacrylate | 250 parts |
| cyclohexyl methacrylate | 200 parts |
| 2-hydroxyethyl methacrylate | 350 parts |
| 2,2'-azobis(2-methylbutyronitrile) | 50 parts |

After completion of the dropwise addition, the mixture was aged at 130° C. for 1 hour, giving a hydroxyl-containing copolymer solution with a resin solids content of 70%. The obtained resin was analyzed by gel permeation chromatography with the result that it had a number average molecular weight of about 8,000. The resin had a hydroxyl value of 138 mg KOH/g.

To this resin were added 338 parts of the adduct of isophorone diisocyanate and 2-hydroxyethyl acrylate obtained in Production Example 1, 0.4 parts of hydroquinone monomethyl ether, 145 parts of butyl acetate and 0.2 parts of dibutyltin dilaurate. While blowing air into the reaction vessel, the mixture was heated to 80° C. and maintained at the same temperature for 5 hours. After confirming substantially all the isocyanate groups had reacted, the reaction mixture was cooled, giving a solution of resin (resin No. 2) containing radical-polymerizable unsaturated groups and hydroxyl groups with a resin solids content of 70%. The resin had a number average molecular weight of about 10,500, a radical-polymerizable unsaturated group content of 0.72 mol/kg and a hydroxyl value of 68 mg KOH/g.

PRODUCTION EXAMPLE 3

Production of Resin Containing Radical-Polymerizable Unsaturated Groups and Carboxyl Groups Four hundred and eighty parts of butyl acetate was placed into a reaction vessel equipped with a thermometer, a thermostat, a stirrer, a reflux condenser and a dropping funnel, and was heated to 130° C. while feeding nitrogen gas into the reaction vessel. While maintaining the same temperature, a mixed solution of the following monomers and polymerization initiator was added dropwise over 3 hours via the dropping funnel.

| | |
|---|---|
| styrene | 200 parts |
| methyl methacrylate | 300 parts |
| cyclohexyl methacrylate | 150 parts |
| acrylic acid | 350 parts |
| 2,2'-azobis(2-methylbutyronitrile) | 50 parts |

After completion of the dropwise addition, the mixture was aged at 130° C. for 1 hour, giving a carboxyl-containing copolymer solution with a resin solids content of 70%. The obtained resin was analyzed by gel permeation chromatography with the result that it had a number average molecular weight of about 8,000. The resin had an acid value of 260 mg KOH/g. To this resin were added 284 parts of glycidyl methacrylate, 0.4 parts of hydroquinone monomethyl ether, 122 parts of butyl acetate and 3 parts of tetraethylammonium bromide. While blowing air into the reaction vessel, the mixture was heated to 110° C. and maintained at the same temperature for 5 hours. After confirming substantially all the glycidyl groups had reacted, the reaction mixture was cooled, giving a solution of resin (resin No. 3) containing radical-polymerizable unsaturated groups and carboxyl groups with a resin solids content of 70%. The resin had a number average molecular weight of about 10,000, a radical-polymerizable unsaturated group content of 1.50 mol/kg and an acid value of 120 mg KOH/g.

PRODUCTION EXAMPLE 4

Production of Hydroxyl-Containing Resin

Four hundred and eighty parts of butyl acetate was placed into a reaction vessel equipped with a thermometer, a thermostat, a stirrer, a reflux condenser and a dropping funnel, and was heated to 130° C. while feeding nitrogen gas into the reaction vessel. While maintaining the same temperature, a mixed solution of the following monomers and polymerization initiator was added dropwise over 3 hours via the dropping funnel.

| | |
|---|---|
| styrene | 200 parts |
| methyl methacrylate | 290 parts |
| cyclohexyl methacrylate | 250 parts |
| 2-hydroxyethyl methacrylate | 260 parts |
| 2,2'-azobis(2-methylbutyronitrile) | 50 parts |

After completion of the dropwise addition, the mixture was aged at 130° C. for 1 hour, giving a solution of hydroxyl-containing copolymers (resin No. 4) with a resin solids content of 70%. The obtained resin was analyzed by gel permeation chromatography with the result that it had a number average molecular weight of about 8,000. The resin had a hydroxyl value of 107 mg KOH/g.

PRODUCTION EXAMPLE 5

Production of Hydroxyl-Containing Resin

Two hundred and ninety-six parts of phthalic acid, 292 parts of adipic acid, 186 parts of ethylene glycol and 312 parts of neopentyl glycol were placed into a reaction vessel equipped with a thermometer, a thermostat, a stirrer, a reflux condenser and a water separator, and the mixture was heated to 160° C. The mixture was then dehydrated while being heated to 220° C. over 2 hours. Thereafter, a small amount of xylene was placed into the reaction vessel, and the water produced by condensation was azeotropically removed. After confirming substantially all the acids had reacted, the reaction mixture was cooled, and xylene was added thereto, giving a solution of hydroxyl-containing polyester resin (resin No. 5) with a resin solids content of 80%. The obtained resin was analyzed by gel permeation chromatography with the result that it had a number average molecular weight of about 1,000. The resin had a hydroxyl value of 112 mg KOH/g.

PRODUCTION EXAMPLE 6

Production of Carboxyl-Containing Resin

Four hundred and eighty parts of butyl acetate was placed into a reaction vessel equipped with a thermometer, a thermostat, a stirrer, a reflux condenser and a dropping funnel, and was heated to 130° C. while feeding nitrogen gas into the reaction vessel. While maintaining the same temperature, a mixed solution of the following monomers and polymerization initiator was added dropwise over 3 hours via the dropping funnel.

| | |
|---|---|
| styrene | 200 parts |
| methyl methacrylate | 300 parts |
| cyclohexyl methacrylate | 350 parts |
| acrylic acid | 150 parts |
| 2,2'-azobis(2-methylbutyronitrile) | 50 parts |

After completion of the dropwise addition, the reaction mixture was aged at 130° C. for 1 hour, giving a solution of carboxyl-containing copolymers (resin No. 6) with a resin solids content of 70%. The obtained resin was analyzed by gel permeation chromatography with the result that it had a number average molecular weight of about 8,000. The resin had an acid value of 111 mg KOH/g.

PRODUCTION EXAMPLE 7

Production of Epoxy-Containing Compound

Four hundred and eighty parts of butyl acetate was placed into a reaction vessel equipped with a thermometer, a thermostat, a stirrer, a reflux condenser and a dropping funnel, and was heated to 130° C. while feeding nitrogen gas into the reaction vessel. While maintaining the same temperature, a mixed solution of the following monomers and polymerization initiator was added dropwise over 3 hours via the dropping funnel.

| | |
|---|---|
| styrene | 200 parts |
| methyl methacrylate | 250 parts |
| cyclohexyl methacrylate | 250 parts |
| glycidyl methacrylate | 300 parts |
| 2,2'-azobis(2-methylbutyronitrile) | 50 parts |

After completion of the dropwise addition, the reaction mixture was aged at 130° C. for 1 hour, giving a solution of epoxy-containing copolymers (resin No. 7) with a resin solids content of 70%. The obtained resin was analyzed by gel permeation chromatography with the result that it had a number average molecular weight of about 8,000. The resin had an epoxy equivalent of 498.

PRODUCTION EXAMPLE 8

Production of Coating Composition

Twenty parts (calculated as solids) of the solution of resin (resin No. 1) containing radical-polymerizable unsaturated groups obtained in Production Example 1, 10 parts of dipentaerythritol hexaacrylate, 70 parts (as solids) of the solution of hydroxyl-containing copolymers (resin No. 4) obtained in Production Example 4, and 23 parts of methylated/butylated melamine resin (trade name: "Cymel 235", product of Mitsui Cytec Ltd.) were mixed with stirring. After 3 parts of photopolymerization initiator (trade names: "IRGACURE 819", 1.5 parts; "IRGACURE 184", 1.5 parts, products of Ciba Specialty Chemicals K.K.) were added and dissolved in the mixture, 1.5 parts of ultraviolet absorber (trade name: "TINUVIN 400", product of Ciba Specialty Chemicals K.K.) and 0.7 parts of light stabilizer (trade name: "TINUVIN 144", product of Ciba Specialty Chemicals K.K.) were further added and dissolved in the mixture. The resulting mixture was diluted with xylene to adjust its viscosity to 30 seconds at 20° C. (viscometer: Ford cup No. 4), giving coating composition No. 1 with a solids content of 60%.

PRODUCTION EXAMPLE 9

Production of Coating Composition

Fifteen parts (as solids) of the solution of resin (resin No. 1) containing radical-polymerizable unsaturated groups obtained in Production Example 1, 15 parts of pentaerythritol tetraacrylate, 70 parts (as solids) of the solution of hydroxyl-containing copolymers (resin No. 4) obtained in Production Example 4, and 26 parts of isocyanurate-modified hexamethylene diisocyanate (trade name: "Sumidur N-3300", product of Sumika Bayer Urethane Co., Ltd., solids: 100%) were mixed with stirring. After 3 parts of photopolymerization initiator (trade names: "IRGACURE 819", 1.5 parts; "IRGACURE 184", 1.5 parts, products of Ciba Specialty Chemicals K.K.) were added and dissolved in the mixture, 2 parts of ultraviolet absorber (trade name: "TINUVIN 400", product of Ciba Specialty Chemicals K.K.) and 1 part of light stabilizer (trade name: "TINUVIN 144", product of Ciba Specialty Chemicals K.K.) were further added and dissolved in the mixture. The resulting mixture was diluted with xylene to adjust its viscosity to 30 seconds at 20° C. (viscometer: Ford cup No. 4), giving coating composition No. 2 with a solids content of 65%.

PRODUCTION EXAMPLE 10

Production of Coating Composition

One hundred parts (as solids) of the solution of resin (resin No. 2) containing radical-polymerizable unsaturated groups and hydroxyl groups obtained in Production Example 2, and 23 parts of isocyanurate-modified hexamethylene diisocyanate (trade name: "Sumidur N-3300", product of Sumika Bayer Urethane Co., Ltd., solids: 100%) were mixed with stirring. After 5 parts of photopolymerization initiator (trade name: "IRGACURE 819", product of Ciba Specialty Chemicals K.K.) was added and dissolved in the mixture, 1.5 parts of ultraviolet absorber (trade name: "TINUVIN 400", product of Ciba Specialty Chemicals K.K.) and 0.7 parts of light stabilizer (trade name: "TINUVIN 144", product of Ciba Specialty Chemicals K.K.) were further added and dissolved in the mixture. The resulting mixture was diluted with xylene to adjust its viscosity to 25 seconds at 20° C. (viscometer: Ford cup No. 4), giving coating composition No. 3 with a solids content of 45%.

PRODUCTION EXAMPLE 11

Production of Coating Composition

Forty-seven parts (as solids) of the solution of resin (resin No. 2) containing radical-polymerizable unsaturated groups and hydroxyl groups obtained in Production Example 2, 53 parts (as solids) of the solution of hydroxyl-containing polyester resin (resin No. 5) obtained in Production Example 5, and 37 parts of methylated/butylated melamine resin (trade name: "Cymel 235", product of Mitsui Cytec Ltd.) were mixed with stirring. After 3 parts of photopolymerization initiator (trade name: "IRGACURE 819", product of Ciba Specialty Chemicals K.K.) was added and dissolved in the mixture, 1.5 parts of ultraviolet absorber (trade name: "TINUVIN 400", product of Ciba Specialty Chemicals K.K.) and 0.7 parts of light stabilizer (trade name: "TINUVIN 144", product of Ciba Specialty Chemicals K.K.) were further added and dissolved in the mixture. The resulting mixture was diluted with xylene to adjust its viscosity to 25 seconds at 20°

C. (viscometer: Ford cup No. 4), giving coating composition No. 4 with a solids content of 52%.

PRODUCTION EXAMPLE 12

Production of Coating Composition

Fifty-two parts (as solids) of the solution of resin (resin No. 3) containing radical-polymerizable unsaturated groups and carboxyl groups obtained in Production Example 3, 28 parts (as solids) of the solution of epoxy-containing copolymers (resin No. 7) obtained in Production Example 7, and 20 parts of pentaerythritol tetraacrylate were mixed with stirring. After 5 parts of photopolymerization initiator (trade name: "IRGACURE 819", product of Ciba Specialty Chemicals K.K.) was added and dissolved in the mixture, 0.6 parts of ultraviolet absorber (trade name: "TINUVIN 400", product of Ciba Specialty Chemicals K.K.) and 0.3 parts of light stabilizer (trade name: "TINUVIN 144", product of Ciba Specialty Chemicals K.K.) were further added and dissolved in the mixture. The resulting mixture was diluted with xylene to adjust its viscosity to 25 seconds at 20° C. (viscometer: Ford cup No. 4), giving coating composition No. 5 with a solids content of 45%.

PRODUCTION EXAMPLE 13

Production of Coating Composition

Ten parts of isocyanuric acid ethylene oxide-modified triacrylate, 20 parts of dipentaerythritol hexaacrylate, 40 parts (as solids) of the solution of carboxyl-containing copolymers (resin No. 6) obtained in Production Example 6, and 30 parts (as solids) of the solution of epoxy-containing copolymers (resin No. 7) obtained in Production Example 7 were mixed with stirring. After 3 parts of photopolymerization initiator (trade name: "IRGACURE 819", product of Ciba Specialty Chemicals K.K.) was added and dissolved in the mixture, 2 parts of ultraviolet absorber (trade name: "TINUVIN 400", product of Ciba Specialty Chemicals K.K.) and 1 part of light stabilizer (trade name: "TINUVIN 144", product of Ciba Specialty Chemicals K.K.) were further added and dissolved in the mixture. The resulting mixture was diluted with xylene to adjust its viscosity to 25 seconds at 20° C. (viscometer: Ford cup No. 4), giving coating composition No. 6 with a solids content of 45%.

PRODUCTION EXAMPLE 14

Production of Coating Composition

One hundred parts (as solids) of the solution of hydroxyl-containing copolymers (resin No. 4) obtained in Production Example 4, and 35 parts of methylated/butylated melamine resin (trade name: "Cymel 235", product of Mitsui Cytec Ltd.) were mixed with stirring. Thereafter, 1 part of ultraviolet absorber (trade name: "TINUVIN 400", product of Ciba Specialty Chemicals K.K.) and 0.5 parts of light stabilizer (trade name: "TINUVIN 144", product of Ciba Specialty Chemicals K.K.) were added and dissolved in the mixture. The resulting mixture was diluted with xylene to adjust its viscosity to 25 seconds at 20° C. (viscometer: Ford cup No. 4), giving coating composition No. 7 with a solids content of 43%.

Table 1 shows the amounts of the components of coating compositions No. 1 to No. 7 on a solids basis.

TABLE 1

| Coating composition | No. 1 | No. 2 | No. 3 | No. 4 | No. 5 | No. 6 | No. 7 |
|---|---|---|---|---|---|---|---|
| Resin No. 1 | 20 | 15 | | | | | |
| Resin No. 2 | | | 100 | 47 | | | |
| Resin No. 3 | | | | | 52 | | |
| Resin No. 4 | 70 | 70 | | | | | 100 |
| Resin No. 5 | | | | 53 | | | |
| Resin No. 6 | | | | | | 40 | |
| Resin No. 7 | | | | | 28 | 30 | |
| Isocyanuric acid ethylene oxide-modified triacrylate | | | | | | 10 | |
| Pentaerythritol tetraacrylate | | 15 | | | 20 | | |
| Dipentaerythritol hexaacrylate | 10 | | | | | 20 | |
| Cymel 235 | 23 | | | 37 | | | 35 |
| Sumidur N-3300 | | 26 | 23 | | | | |
| IRGACURE 184 | 1.5 | 1.5 | | | | | |
| IRGACURE 819 | 1.5 | 1.5 | 5 | 3 | 5 | 3 | |
| TINUVIN 400 | 1.5 | 2 | 1.5 | 1.5 | 0.6 | 2 | 1 |
| TINUVIN 144 | 0.7 | 1 | 0.7 | 0.7 | 0.3 | 1 | 0.5 |

PRODUCTION EXAMPLE 15

Production of Test Sheet

A zinc phosphate-treated dull steel sheet (length: 25 cm, width: 25 cm, thickness: 0.8 mm) was coated with an epoxy cationic electrodeposition coating composition by electrodeposition to a film thickness of about 20 μm (when cured). The coated sheet was heated at 170° C. for 20 minutes to cure the coating film, thereafter sanded with sandpaper #400 and degreased by wiping with material soaked in petroleum benzine. The sheet was further coated with a coating composition for an automobile intermediate coat (trade name: "TP-65-2", alkyd resin/melamine resin thermosetting coating composition, product of Kansai Paint Co., Ltd.) by air spraying to a coating thickness of about 25 μm (when cured). The coated sheet was heated at 140° C. for 30 minutes to cure the coating film, thereafter subjected to wet sanding with sandpaper #400 and dried off. Furthermore, the sheet was coated with a black waterborne coating composition for a base coat (trade name: "WBC-710T (black)", acrylic resin/melamine resin thermosetting coating composition, product of Kansai Paint Co., Ltd.) to a coating thickness of 20 μm (when cured) and was heated at 80° C. for 10 minutes to dry the coating film, thus giving a test sheet.

EXAMPLE 1

The test sheet obtained in Production Example 15 was coated with coating composition No. 1 by air spraying to a coating thickness of 40 μm (when cured), and was left to stand at room temperature for 7 minutes to form a wet coating film. The coating film was then heated in an air-heating furnace at 140° C. for 20 minutes to form a semicured coating film. To improve surface quality, dust or other foreign matter adhering to the semicured coating film surface was removed by sanding the film, followed by polishing of the film using a polishing compound.

Subsequently, using a 120 W/cm metal halide lamp as a light source, the coating film was irradiated with ultraviolet light (wavelength: 365 nm) for about 10 seconds at a dosage of 1,000 mJ/cm$^2$. The semicured coating film was thus substantially fully cured to form a clear top coat.

EXAMPLES 2 TO 6

The procedure of Example 1 was repeated except that coating compositions No. 2 to No. 6 were used in place of coating composition No. 1. The wet coating film was heated under the conditions shown in Table 2, thereafter irradiated with light in the same manner as in Example 1, to form a clear top coating film.

Table 2 shows the coating compositions and film-curing conditions used in Examples 1 to 6.

TABLE 2

| | | Example | | | | | |
|---|---|---|---|---|---|---|---|
| | | 1 | 2 | 3 | 4 | 5 | 6 |
| Coating composition | | No. 1 | No. 2 | No. 3 | No. 4 | No. 5 | No. 6 |
| Heating conditions | Temperature (° C.) | 140 | 140 | 80 | 140 | 120 | 120 |
| | Time(min) | 20 | 10 | 15 | 20 | 15 | 20 |
| Irradiation conditions (dosage, mJ/cm$^2$) | | 1,000 | 1,000 | 1,000 | 1,000 | 1,000 | 1,000 |

COMPARATIVE EXAMPLE 1

The test sheet obtained in Production Example 15 was coated with coating composition No. 7 obtained in Production Example 14 by air spraying to a coating thickness of 40 μm (when cured), and was left to stand at room temperature for 7 minutes to form a wet coating film. The coating film was then heated in an air-heating furnace at 140° C. for 40 minutes to substantially fully cure, thus forming a clear top coating film. To improve surface quality, dust or other foreign matter adhering to the cured coating film surface was removed by sanding the film, followed by polishing of the film using a polishing compound.

COMPARATIVE EXAMPLES 2 TO 4

The test sheet obtained in Production Example 15 was coated with coating composition No. 1, No. 2 or No. 6 by air spraying to a coating thickness of 40 μm (when cured), and was left to stand at room temperature for 7 minutes to form a wet coating film. Subsequently, using a 120 W/cm metal halide lamp as a light source, the coating film was irradiated with ultraviolet light (wavelength: 365 nm) for about 10 seconds at a dosage of 1,000 mJ/cm$^2$ to cure the coating film surface. To improve surface quality, dust or other foreign matter adhering to the surface-cured film was removed by sanding the film, followed by polishing of the film using a polishing compound. Removal of dust and the like firmly fixed to the surface-cured film was difficult, and polishing took a longer time.

Subsequently, the surface-cured coating film was heated at 140° C. for 20 minutes to substantially fully cure, thus forming a clear top coating film.

Table 3 shows the coating compositions and film-curing conditions used in Comparative. Examples 1 to 4.

TABLE 3

| | | Comparative Example | | | |
|---|---|---|---|---|---|
| | | 1 | 2 | 3 | 4 |
| Coating composition | | No. 7 | No. 1 | No. 2 | No. 6 |
| Irradiation conditions (dosage, mJ/cm$^2$) | | 0 | 1,000 | 1,000 | 1,000 |
| Heating conditions | Temperature(° C.) | 140 | 140 | 140 | 140 |
| | Time(min) | 40 | 20 | 10 | 20 |

The coating film repairability of the film formation methods of Examples 1 to 6 and Comparative Examples 1 to 4, and the properties of the clear top coating films formed in these examples were tested as follows:

Coating film repairability: For repair, dust or other foreign matter adhering to the semicured or cured coating film surface was removed by sanding the coating film, and subsequently the traces left by sanding were erased by polishing with a polishing agent. Coating film repairability was evaluated according to the following criteria:

A: Removing dust and the like and polishing the coating film is easy.

B: Removing dust and the like and polishing the coating film is somewhat difficult.

C: Removing dust and the like and polishing the coating film is difficult.

Coating surface smoothness: The coating film surface was checked with the naked eye to evaluate its smoothness according to the following criteria:

A: The coating film surface is smooth.

B: The coating film surface has an orange peel-like appearance.

60-degree specular gloss: Light reflectance (%) was measured according to the procedure defined in JIS K-5400 7.6 (1990).

Xylene-rubbing resistance: The coating surface was wiped for 50 reciprocatory strokes with a gauze soaked with xylene and was observed to evaluate the curing degree of the coating film according to the following criteria:

A: No changes occur on the coating surface. The coating film is sufficiently cured.

B: The coating surface is marred. The coating film is not sufficiently cured.

C: The coating surface is dissolved by the xylene. The curing of the coating film is far from sufficient.

Adhesion: The cured coating film was given crosscuts with a cutter reaching down to the substrate surface so as to form a grid of 100 squares (1 mm×1 mm). Adhesive tape was applied to the surface of the grid portion and forcefully pulled upward. The peeling of the clear top coating film was inspected, counting the number of remaining crosscut squares. Adhesion was evaluated with reference to how many of the 100 crosscut squares remained.

Accelerated weatherability: After conducting a 1,000-hour test using a sunshine weather-o-meter, the coating film was observed to evaluate its condition according to the following criteria:

A: The coating film is almost as glossy as it was before the test.

B: The coating film is less glossy than it was before the test, but it has no defects such as cracking, blushing, etc.

C: The coating film is less glossy than it was before the test, and blushing occurs.

D: The coating film is much less glossy than it was before the test. Cracking and blushing occur.

Table 4 shows the test results.

TABLE 4

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Coating film repairability | A | A | A | A | A | A | A | C | C | C |
| Coating surface smoothness | A | A | A | A | A | A | A | B | B | B |
| 60-degree specular gloss | 95 | 94 | 96 | 95 | 95 | 95 | 90 | 82 | 85 | 81 |
| Xylene-rubbing resistance | A | A | A | A | A | A | A | A | A | A |
| Adhesion | 100 | 100 | 100 | 100 | 100 | 100 | 100 | 100 | 100 | 100 |
| Accelerated weatherability | A | A | A | A | A | A | A | C | C | C |

The method of forming a coating film according to the present invention achieves the following remarkable effects:

(1) As in the conventional method of forming a coating film by heat-curing alone, the present method can form a cured coating film having excellent adhesion, finish quality, weatherability, etc.

(2) Because the present method can drastically shorten the time for heating on an automobile body coating line, the length of a drying furnace line, for example, can be reduced to about half the length usually required. Space and energy thus can be saved.

(3) When repairing a coating film is needed, dust or other foreign matter adhering to the film surface can be easily removed, and subsequent polishing of the film is also easy.

(4) Therefore, especially when forming a coating film on the bodies of vehicles such as automobiles, motorcycles, container vehicles and the like, the present method can increase productivity and reduce costs.

The invention claimed is:

1. A method of forming a coating film on a vehicle body comprising the steps of:

(i) coating the vehicle body with a thermosetting and photocurable clear coating composition to form a wet coating film, (ii) heating the wet coating film at 70° C. to 160° C. for 10 to 20 minutes to obtain a semicured coating film having a hardness between 2B to H on the pencil hardness scale, (ii') grinding and polishing the semicured coating film, and (iii) irradiating the semicured coating film with ultraviolet light having a wavelength of 200 to 450 nm at a dosage of 500 to 1,500 mJ/cm$^2$ for 3 to 60 seconds to cure the coating film;

wherein the clear coating composition comprises a resin containing one or more radical-polymerizable unsaturated groups and one or more thermosetting functional groups per molecule (A), a crosslinking agent (B), a photopolymerization initiator (C), and an organic solvent (D).

2. A method of forming a coating film according to claim 1, wherein the coating composition comprises, per 100 parts by weight of the resin containing one or more radical-polymerizable unsaturated groups and one ore more thermosetting functional groups per molecule (A), about 10 to about 60 parts by weight of the crosslinking agent (B) and about 0.1 to about 10 parts by weight of the photopolymerization initiator (C).

3. A method of forming a coating film according to claim 1, wherein the coating composition comprises the organic solvent (D) in such an amount that the coating composition has a solids content of about 20% to about 90% by weight.

4. A method of forming a coating film according to claim 1, wherein the vehicle body is an automobile body.

5. A vehicle body on which a coating film is formed by the method of forming a coating film according to claim 1.

6. An automobile body on which a coating film is formed by the method of forming a coating film according to claim 1.

* * * * *